US008981244B2

(12) United States Patent
Ho et al.

(10) Patent No.: US 8,981,244 B2
(45) Date of Patent: Mar. 17, 2015

(54) FORWARD/BACKWARD ROTATION SWITCHING MECHANISM

(71) Applicant: Solteam Electronics Co., Ltd., Taoyuan (TW)

(72) Inventors: Ying-Sung Ho, Taoyuan (TW); Chen-Hong Huang, Taoyuan (TW); Chang-Nan Chen, Taoyuan (TW); Chao-Yi Lee, Taoyuan (TW); Tao-Lung Hsueh, Taoyuan (TW); Cheng-Wei Lu, Taoyuan (TW)

(73) Assignee: Solteam Electronics Co., Ltd. (TW)

( * ) Notice: Subject to any disclaimer, the term of this patent is extended or adjusted under 35 U.S.C. 154(b) by 305 days.

(21) Appl. No.: 13/714,423

(22) Filed: Dec. 14, 2012

(65) Prior Publication Data

US 2014/0166449 A1 Jun. 19, 2014

(51) Int. Cl.
*H01H 19/14* (2006.01)

(52) U.S. Cl.
CPC ..... *H01H 19/14* (2013.01)
USPC ..... 200/11 J; 200/564

(58) Field of Classification Search
CPC ..... H01H 19/06; H01H 19/08; H01H 19/14; H01H 9/04
USPC ..... 200/11 J, 11 R, 302.1, 302.2, 302.3, 200/564–569
See application file for complete search history.

(56) References Cited

U.S. PATENT DOCUMENTS

| | | | | |
|---|---|---|---|---|
| 6,610,938 | B2 * | 8/2003 | Funfer | 200/11 R |
| 7,705,260 | B2 * | 4/2010 | Xu | 200/522 |
| 8,330,066 | B2 * | 12/2012 | Xu | 200/522 |

* cited by examiner

*Primary Examiner* — Amy Cohen Johnson
*Assistant Examiner* — Marina Fishman

(57) ABSTRACT

The present invention relates to a forward/backward rotation switching mechanism, comprising: a cover, a turntable, a terminal-fixing body, a first contact terminal, and a second contact terminal. In the present invention, a plurality of dust-off trenches are especially formed on the peripheral edges of the turntable for preventing from the dust accumulation between the turntable and a cover; therefore, even if the forward/backward rotation switching mechanism is used in an environment having a lot of dust, the turntable can still be turned around because the dust is ruled out by the dust-off trenches.

10 Claims, 8 Drawing Sheets

FORWARD/BACKWARD ROTATION SWITCHING MECHANISM

BACKGROUND OF THE INVENTION

1. Field of the Invention

The present invention relates to a switch structure applied in push switches, and more particularly to a forward/backward rotation switching mechanism.

2. Description of the Prior Art

"Switch" is a necessary mechanism for electrical equipments and electronic products, such as refrigerators, TVs, extension cords, computers, and video game consoles, all the aforesaid equipments and devices need the switch for turning on/off the power thereof. Push switch is the most conventional used switch.

Please refer to FIG. 1, there is shown a stereo view of a conventional push switch. As shown in FIG. 1, the conventional push switch 1' is applied in an electric hand-held device for controlling the rotation of a motor, including: a trigger 10', a sliding mechanism 11', a first switching shaft 12', a second switching shaft 13', negative power connecting member 14', a supporting member 15', a connecting member 16', a positive and negative terminals connecting module 18', a positive power connecting member 19', a forward/backward rotation switching mechanism 20', a compensation type electronic control circuit 21', a diode 22', a stop member 17, a first tension spring 24', a second tension spring 25', a first cover 231', a second cover 232', and a heat-sink 26'.

Continuously refer to FIG. 1, and please refer to FIG. 2, FIG. 3 and FIG. 4, there are shown a stereo view of the positive and negative terminals connecting module, an exploded view of the forward/backward rotation switching mechanism, and an assembly drawing of some parts of the conventional push switch. The positive and negative terminals connecting module 18' includes a positive terminal 181' and a negative terminal 182', used for respectively connecting to a positive terminal and a negative terminal of the motor. In addition, the positive and negative terminals connecting module 18' further includes a housing 183' for accommodating the positive terminal 181' and a negative terminal 182'. The forward/backward rotation switching mechanism 20' includes a first switching member 201' and a second switching member 202', wherein the first switching member 201' is initially contacted with the connecting member 16' and the negative terminal 182', and the second switching member 202' is initially contacted with the positive power connecting member 19' and the positive terminal 181'.

In the conventional push switch 1', the rotation way of the motor can be defined by changing the contact of the first switching member 201', the second switching member 202', the positive terminal 181', the negative terminal 182', the connecting member 16', and the positive power connecting member 19'. Moreover, according to the positive and negative terminals connecting module 18', the forward/backward rotation switching mechanism 20' further includes: a forward/backward rotation switching stem 205', a switching stem fixing member 206', a third compression spring set 203', and a fourth compression spring set 204'. In which, the forward/backward rotation switching stem 205' has a rear swing portion 2052' and a front swing portion 2051'. The rear swing portion 2052' is provided with a plurality of apertures 2053' for combining with the first switching member 201' and the second switching member 202'. Because the front swing portion 2051' is pivotally connected with the rear swing portion 2052', the rear swing portion 2052' would oppositely move after pushing the front swing portion 2052', such that the contact of the first switching member 201', the second switching member 202', the positive terminal 181', the negative terminal 182', the connecting member 16', and the positive power connecting member 19' can be changed.

Thus, by above descriptions, it is able to know that the conventional push switch 1' can not only control the rotation of the motor, but also switch the motor to a forward rotation or a backward rotation; However, the conventional push switch 1' still includes shortcomings and drawbacks as follows:

(1) When being assembled, the first switching member 201' and the second switching member 202' are firstly inserted into the apertures 2053' of the forward/backward rotation switching mechanism 20', and then the first switching member 201', the second switching member 202' and the forward/backward rotation switching mechanism 20' are directly put on the positive and negative terminals connecting module 18'; thus, because the first switching member 201' and the second switching member 202' does not be provided with any locking structures, the first switching member 201' and the second switching member 202' may fall out of the apertures 2053' when the first switching member 201', the second switching member 202' and the forward/backward rotation switching mechanism 20' are directly put on the positive and negative terminals connecting module 18'; that is a main problem when assembling the conventional push switch 1'.

(2) There has no any dust-off or anti-dust mechanism between the rear swing portion 2052' and the front swing portion 2051', so that, the external dust would be accumulated in the connection point of the rear swing portion 2052' and the front swing portion 2051', and eventually the forward/backward rotation switching stem 205' cannot be operated normally.

(3) Moreover, in the conventional push switch 1', although it can pushes the front swing portion 2052' for easily switching and controlling the motor to make the forward rotation or the backward rotation, the rear swing portion 2052' may break away from the fixing of the switching stem fixing member 206' when being subject to an external force, and then the motor cannot be switched and controlled normally.

Accordingly, in view of the conventional push switch still have shortcomings and drawbacks, the inventor of the present application has made great efforts to make inventive research thereon and eventually provided a forward/backward rotation switching mechanism.

SUMMARY OF THE INVENTION

The first objective of the present invention is to provide a forward/backward rotation switching mechanism, in which each of terminal-housing grooves are provided with two terminal-locking portions and two first locking portions and two second locking portions are formed on corresponding contact terminals, respectively; therefore, after the contact terminals are assembled into the terminal-housing grooves, their locking portions would lock the terminal-locking portions, such that the contact terminals can be prevented from falling out of the terminal-housing grooves.

The second objective of the present invention is to provide a forward/backward rotation switching mechanism, in which a plurality of dust-off trenches are formed on the peripheral edges of a turntable for preventing from the dust accumulation between the turntable and a cover; therefore, even if the forward/backward rotation switching mechanism is used in an environment having a lot of dust, the turntable can still be turned around because the dust is ruled out by the dust-off trenches.

The third objective of the present invention is to provide a forward/backward rotation switching mechanism, in which the contact terminals and the turntable are assembled with a terminal-fixing body, and the terminal fixing body is fixed in the cover through a fixing ball and a return spring; thus, when the turn handle is forced to make the turntable rotate forwardly, the motor is switched and makes a forward rotation, meanwhile, unless forcing the turn handle to make the turntable rotate backwardly, the rotation way of the motor would not be influenced even if the switch device is subject to push or vibration made by external forces.

Accordingly, to achieve the objectives of the present invention, the inventor of the present invention provides a forward/backward rotation switching mechanism, which is adapted for being disposed in a switch device and used for assisting the switch device in controlling a forward rotation and a backward rotation of a motor, the forward/backward rotation switching mechanism comprising:

a cover, provided a turntable-corresponding recess on the top thereof, and a sliding groove is formed on the bottom surface of the turntable-corresponding recess;

a turntable, accommodated in the cover and opposite to the turntable-corresponding recess, and having a turn handle and an embedding block, wherein the turn handle is disposed in the sliding groove, and the embedding block comprises an embedding member and an inserting member;

a terminal-fixing body, comprising: a housing groove, having a first housing portion and a second housing portion, wherein the bottom of the embedding member and the inserting member are embedded into the first housing portion and the second housing portion, respectively; and two terminal-housing grooves;

a first contact terminal, disposed in one of the terminal-housing grooves of the terminal-fixing body; and a second contact terminal, disposed in the other terminal-housing groove of the terminal-fixing body, wherein the terminal-fixing body may be driven to rotate by forcing to the turn handle and rotating the turntable, therefore the first contact terminal and the second contact terminal would contact with the terminals inside the switch device, and then the motor is switched and controlled to make the forward rotation or the backward rotation.

BRIEF DESCRIPTION OF THE DRAWINGS

The invention as well as a preferred mode of use and advantages thereof will be best understood by referring to the following detailed description of an illustrative embodiment in conjunction with the accompanying drawings, wherein:.

DETAILED DESCRIPTION OF THE PREFERRED EMBODIMENTS

To more clearly describe a forward/backward rotation switching mechanism according to the present invention, embodiments of the present invention will be described in detail with reference to the attached drawings hereinafter.

Figure 1:
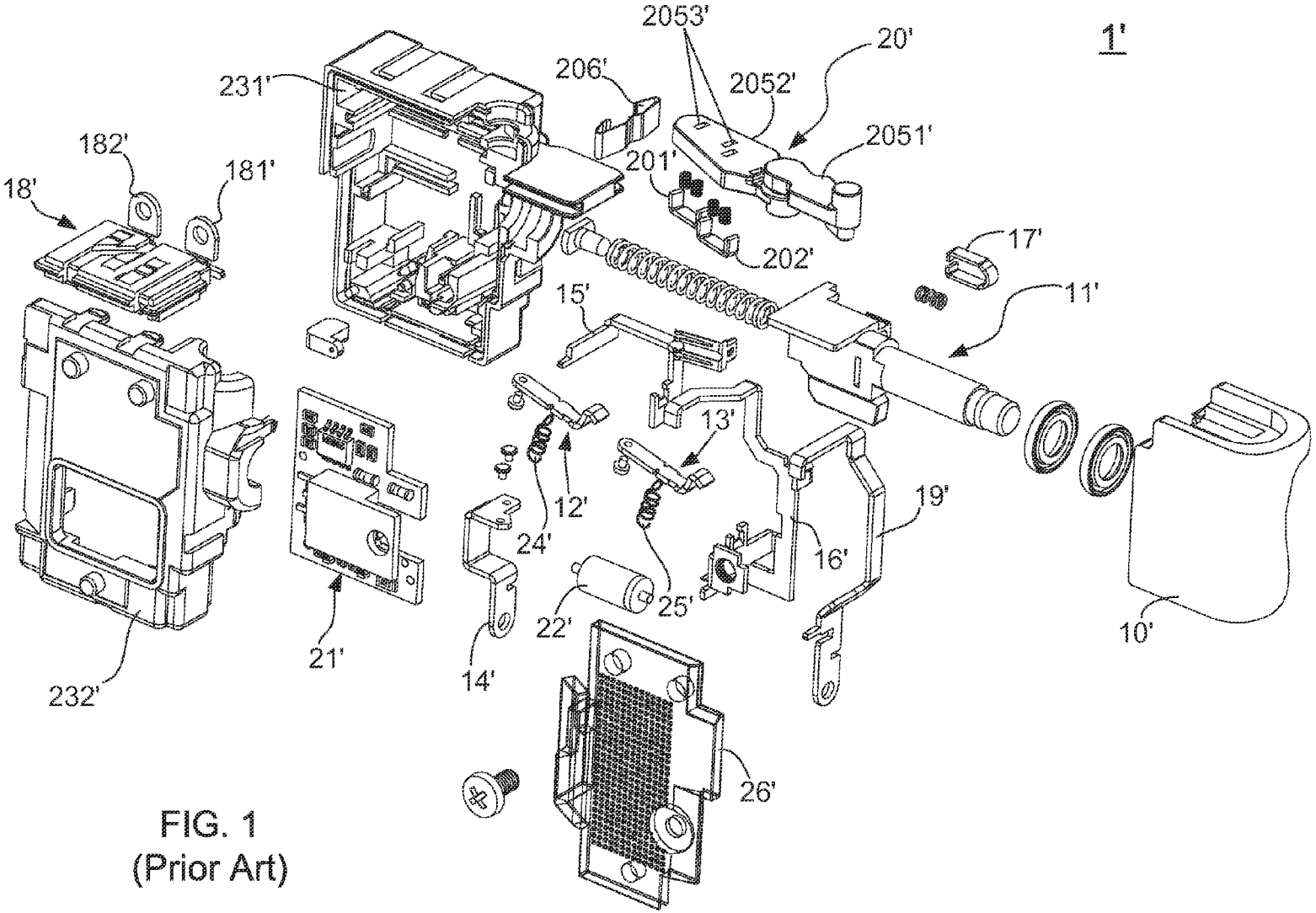
FIG. 1 (Prior Art)
FIG. 1 is a stereo view of a conventional push switch.
Figure 2:
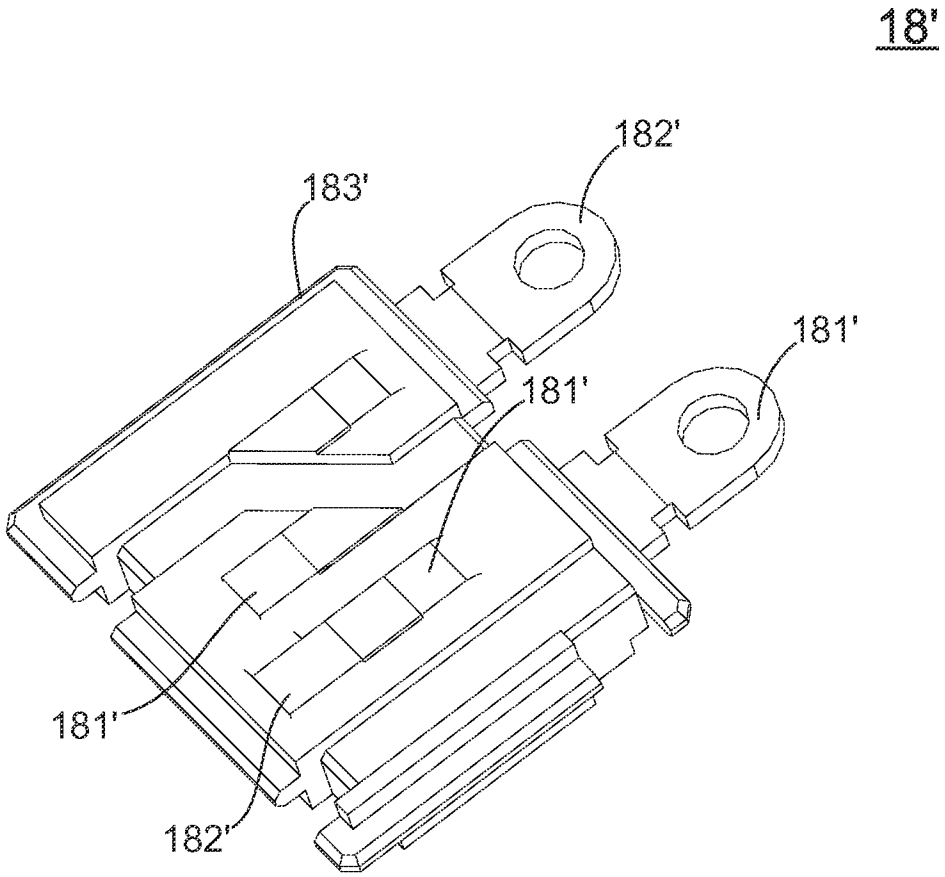
FIG. 2 (Prior Art)
FIG. 2 is a stereo view of a positive and negative terminals connecting module.
Figure 3:
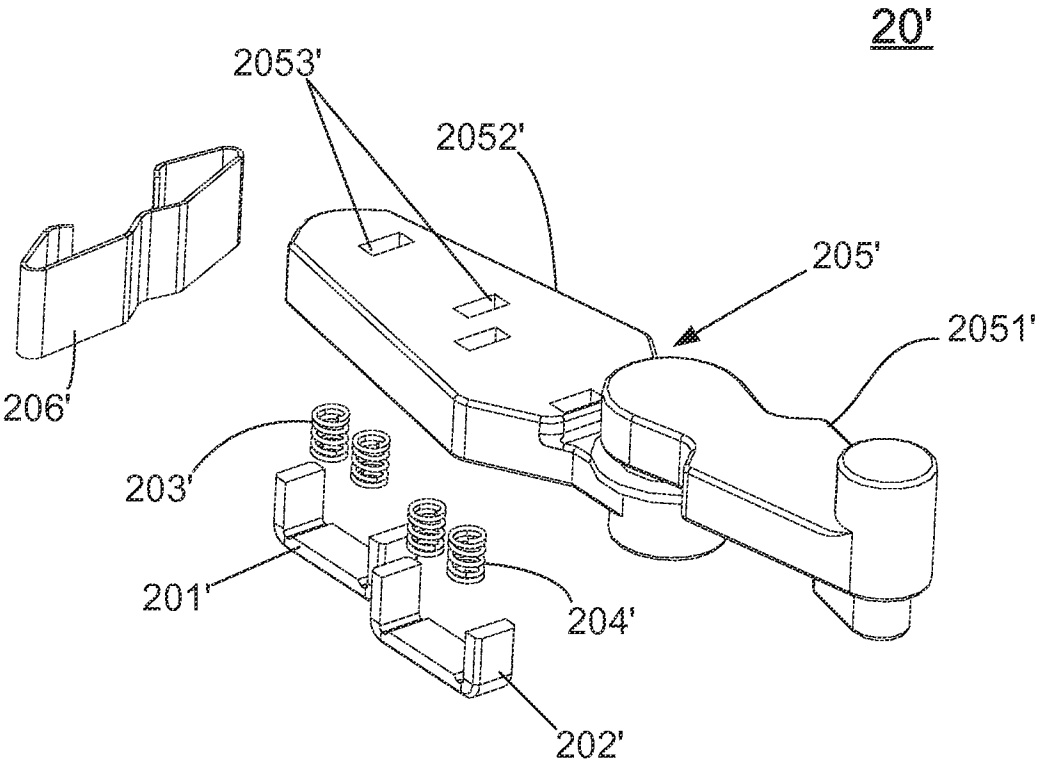
FIG. 3 (Prior Art)
FIG. 3 is an exploded view of a forward/backward rotation switching mechanism of the conventional push switch.
Figure 4:
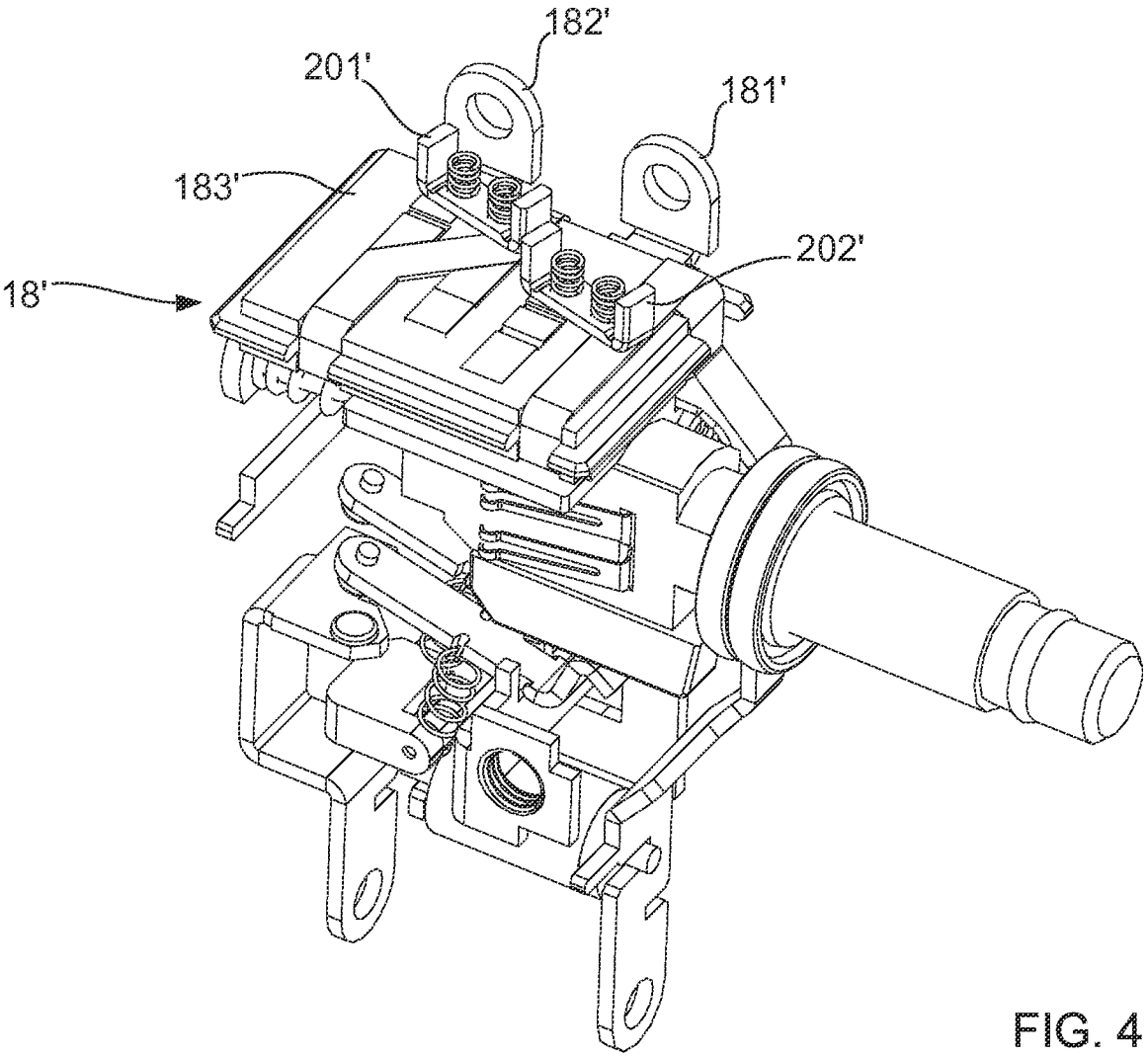
FIG. 4 (Prior Art)
FIG. 4 is an assembly drawing of some parts of the conventional push switch.
Figure 5:
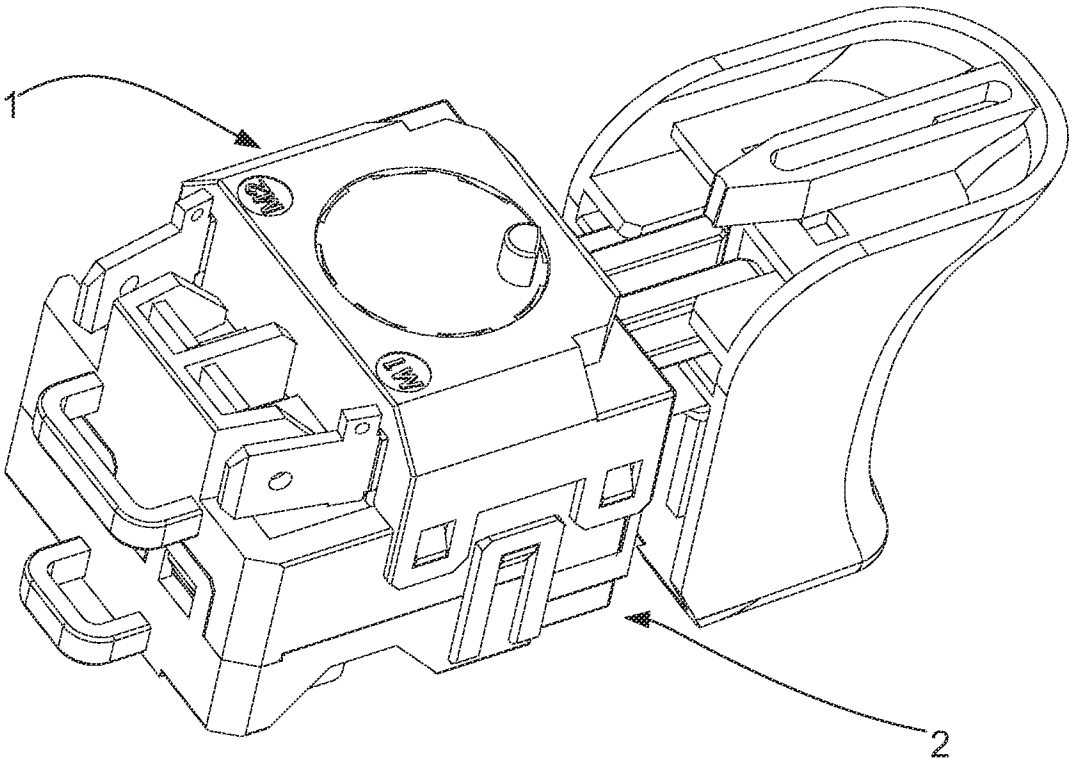
FIG. 5 is a stereo view of a switch device provided with a forward/backward rotation switching mechanism introduced by the present invention.
Figure 6:
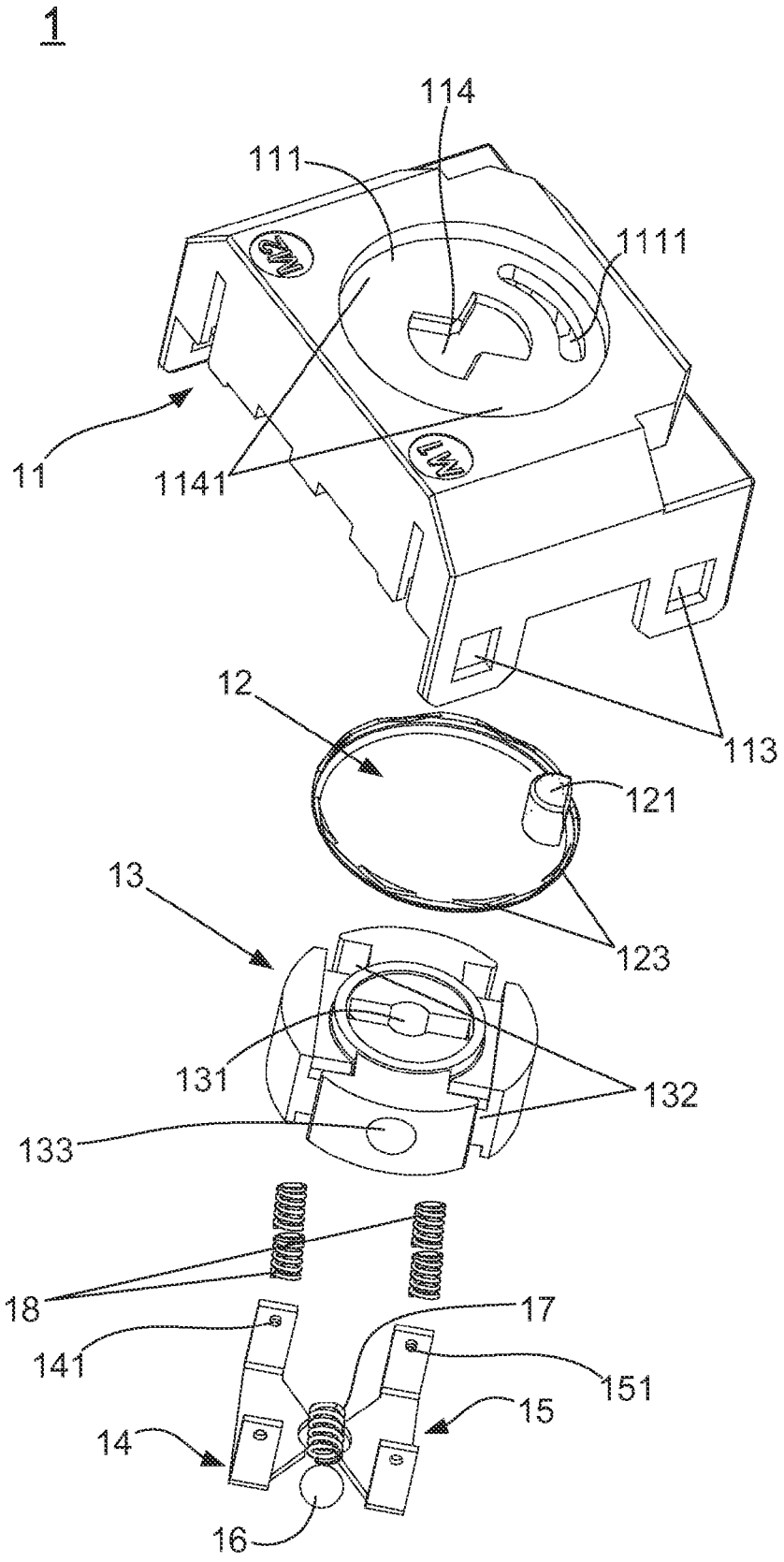
FIG. 6 is an exploded view of the forward/backward rotation switching mechanism according to the present invention.

Please refer to FIG. 5, there is shown a stereo view of a switch device provided with a forward/backward rotation switching mechanism introduced by the present invention; moreover, please simultaneously refer to FIG. 6, which illustrates an exploded view of the forward/backward rotation switching mechanism introduced by the present invention. As shown in FIG. 5 and FIG. 6, the forward/backward rotation switching mechanism 1 of the present invention is adapted for being disposed in a switch device 2 and used for assisting the switch device 2 in controlling a forward rotation and a backward rotation of a motor, the forward/backward rotation switching mechanism 1 includes: a cover 11, a turntable 12, a terminal-fixing body 13, a first contact terminal 14, a second contact terminal 15, and a plurality of terminal springs 18.

Figure 7:
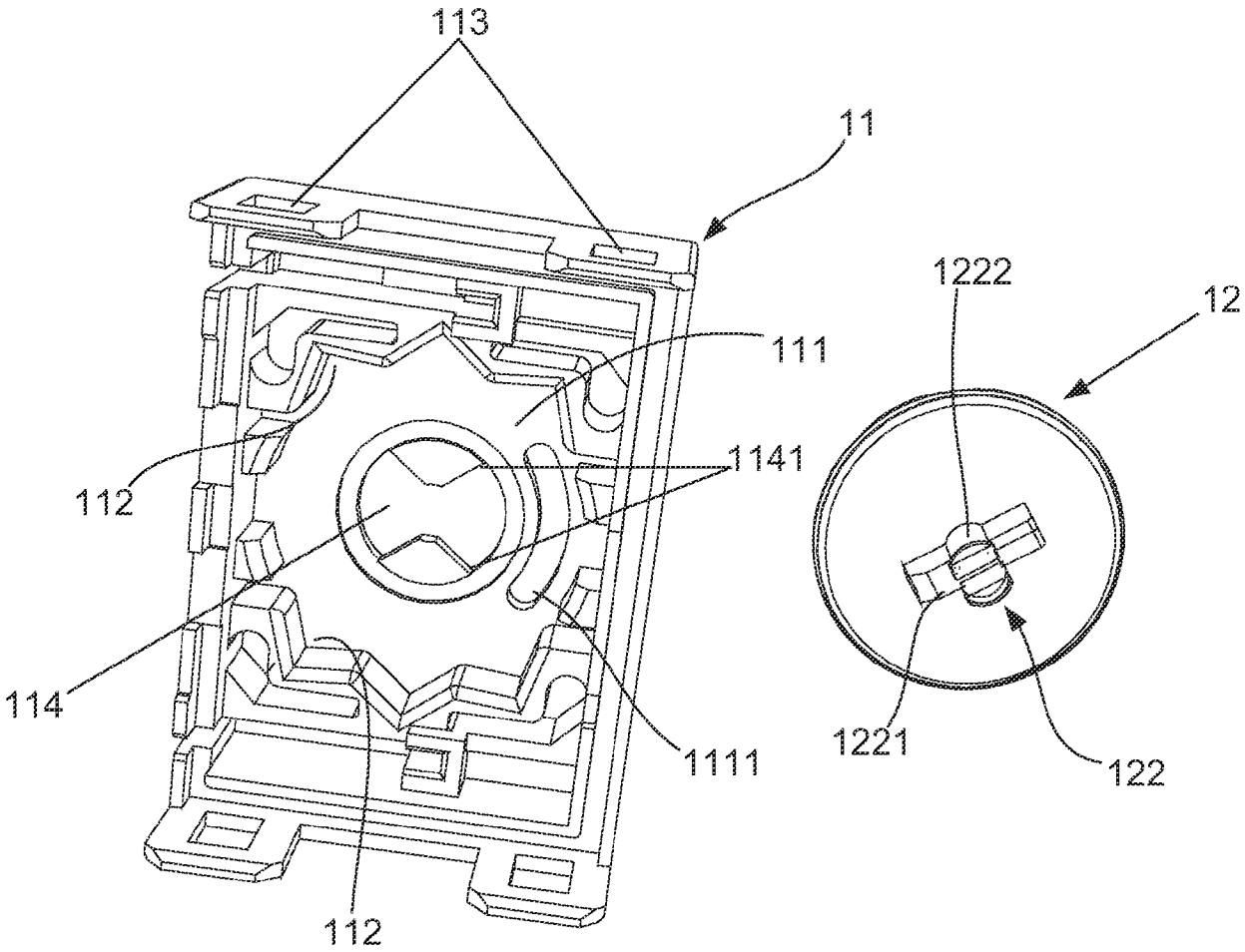
FIG. 7 is a stereo view of a cover and a turntable of the forward/backward rotation switching mechanism.
Figure 8B:
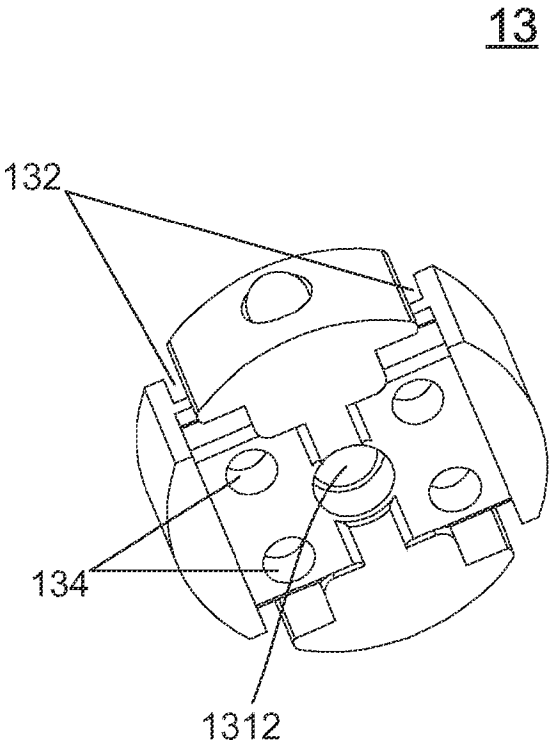
FIG. 8B is a second stereo view of the terminal-fixing body.
Figure 8A:
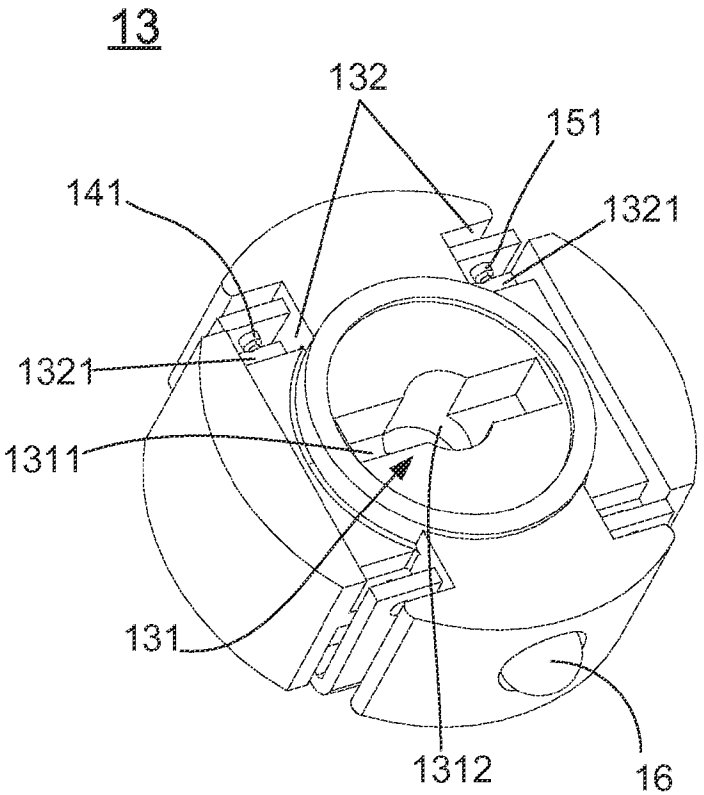
FIG. 8A is a stereo view of a terminal-fixing body of the forward/backward rotation switching mechanism.

Referring to FIG. 5 and FIG. 6 again, and please refer to FIG. 7, FIG. 8A and FIG. 8B simultaneously, there are respectively shown stereo views of the cover, the turntable and the terminal-fixing body. As shown in FIGs., the cover 11 includes: a turntable-corresponding recess 111, two ball recesses 112, a plurality of locking structures 113, and a circuitous embedding opening 114, wherein the turntable-corresponding recess 111 is formed on the top of the cover 11, and a sliding groove 1111 is formed on the bottom surface of the turntable-corresponding recess 111. The two ball recesses 112 are formed on the inner surface of the cover 11 and corresponding to the turntable-corresponding recess 111, the locking structures 113 is formed on the edges of the cover 11 and used for locking the switch device 2, and the circuitous embedding opening 114 is formed on the bottom of the turntable-corresponding recess 111.

The turntable 12 is accommodated in the cover 11 and opposite to the turntable-corresponding recess 111. The turntable 12 has a turn handle 121 and an embedding block 122, wherein the turn handle 121 is disposed in the sliding groove 1111, and the embedding block 122 includes an embedding member 1221 and an inserting member 1222. Besides, the turntable 12 further includes a plurality of dust-off trenches 123, which are formed on the peripheral edges of the turntable 12 for preventing from the dust accumulation between the turntable 12 and the cover 11. So that, even if the forward/backward rotation switching mechanism 1 of the present invention is used in an environment having a lot of dust, the turntable 12 can still be turned around because the dust is ruled out by the dust-off trenches 123.

Moreover, the terminal-fixing body 13 includes: a housing groove 131, two terminal-housing grooves 132, a ball housing 133, and a plurality of spring-accommodating grooves 134, wherein the housing groove 131 has a first housing portion 1311 and a second housing portion 1312. When assembling this forward/backward rotation switching mechanism 1, the top and the bottom of the embedding member 1221 are embedded into the circuitous embedding opening 114 and the housing portion 1311, respectively; in addition, the inserting member 1222 is inserted into the second housing portion 1312. In the present invention, the circuitous embedding opening 114 in the turntable-corresponding recess 111 has circuitous portions 1141 for lengthening the invasion path of the dust, such that the invading dust located between the turntable 12 and the cover 11 can be extremely effectively reduced.

Besides, the two terminal-housing grooves 132 of the terminal-fixing body 132 are used for accommodating the first contact terminal 14 and the second contact terminal 15, and the ball housing 133 is used for housing the fixing ball 16 and the return spring 17. In the operation of the forward/backward rotation switching mechanism 1, the terminal-fixing body 13 may be driven to rotate by forcing to the turn handle 121 and rotating the turntable 12, therefore the first contact terminal 14 and the second contact terminal 15 would contact with the terminals inside the switch device 2 for controlling the motor to make the forward rotation or the backward rotation. Moreover, because the return spring 17 is a compression spring, the fixing ball 16 would be pushed into the ball recess 112 by the return spring 17 when the terminal-fixing body 13 stops rotating, and then the terminal-fixing body 12 is fixed.

Furthermore, the spring-accommodating grooves 134 are formed on the bottom of the terminal-fixing body 13 for accommodating the terminal springs 18, so as to make the terminal springs 18 opposite to the first contact terminal 14 and the second contact terminal 15 in the terminal-housing grooves 132. Therefore, since the terminal springs 18 are also compression springs, the elastic force provided by the terminal springs 18 are able to make the first contact terminal 14 and the second contact terminal 15 contact with the terminals inside the switch device 2 tightly.

In addition, as shown in FIG. 6 and FIG. 8A, in order to prevent the first contact terminal 14 and the second contact terminal 15 from falling out of the terminal-housing grooves 132, each of the terminal-housing grooves 132 are provided with two terminal-locking portions 1321 and two first locking portions 141 and two second locking portions 151 are formed on the first contact terminal 14 and the second contact terminal 15, respectively. Thus, after the first contact terminal 14 and the second contact terminal 15 are assembled into the terminal-housing grooves 132, their locking portions 141, 151 would lock the terminal-locking portions 1321; So that, the first contact terminal 14 and the second contact terminal 15 can be prevented from falling out of the terminal-housing grooves 132.

Thus, through the descriptions, the forward/backward rotation switching mechanism of the present invention has been completely introduced and disclosed; in summary, the present invention has the following advantages:

1. In this forward/backward rotation switching mechanism, for preventing the first contact terminal 14 and the second contact terminal 15 from falling out of the terminal-housing grooves 132, each of the terminal-housing grooves 132 are provided with two terminal-locking portions 1321 and two first locking portions 141 and two second locking portions 151 are formed on the first contact terminal 14 and the second contact terminal 15, respectively; therefore, after the first contact terminal 14 and the second contact terminal 15 are assembled into the terminal-housing grooves 132, their locking portions 141, 151 would lock the terminal-locking portions 1321, such that the first contact terminal 14 and the second contact terminal 15 can be prevented from falling out of the terminal-housing grooves 132.
2. In addition, in order to avoid this forward/backward rotation switching mechanism from getting the external dust into the interior thereof, the turntable 12 is provided with a plurality of dust-off trenches 123; therefore, even if the forward/backward rotation switching mechanism 1 of the present invention is used in an environment having a lot of dust, the turntable 12 can still be turned around because the dust is ruled out by the dust-off trenches 123.
3. Inheriting to above point 2, moreover, in this forward/backward rotation switching mechanism, the circuitous embedding opening 114 on the turntable-corresponding recess 111 has circuitous portions 1141 for lengthening the invasion path of the dust, such that the invading dust located between the turntable 12 and the cover 11 can be extremely effectively reduced.
4. Furthermore, moreover, in this forward/backward rotation switching mechanism, because the turntable 12, the first contact terminal 14 and the second contact terminal 15 are assembled with the terminal-fixing body 13, and the terminal fixing body 13 is fixed in the cover 11 through the fixing ball 16 and the return spring 17; thus, when the turn handle 121 is forced to make the turntable 12 rotate forwardly, the motor is switched and makes a forward rotation, meanwhile, unless forcing the turn handle 121 to make the turntable 12 rotate backwardly, the rotation way of the motor would not be influenced even if the switch device 2 is subject to push or vibration made by external forces.

The above description is made on embodiments of the present invention. However, the embodiments are not intended to limit scope of the present invention, and all equivalent implementations or alterations within the spirit of the present invention still fall within the scope of the present invention.

What is claimed is:

1. A forward/backward rotation switching mechanism, which is adapted for being disposed in a switch device and used for assisting the switch device in controlling a forward rotation and a backward rotation of a motor, the forward/backward rotation switching mechanism comprising:

a cover, being provided a turntable-corresponding recess on the top thereof, and a sliding groove being formed on the bottom surface of the turntable-corresponding recess;

a turntable, being accommodated in the cover and opposite to the turntable-corresponding recess, and having a turn handle and an embedding block, wherein the turn handle is disposed in the sliding groove, and the embedding block comprising an embedding member and an inserting member;

a terminal-fixing body, comprising:

a housing groove, having a first housing portion and a second housing portion, wherein the bottom of the embedding member and the inserting member are embedded into the first housing portion and the second housing portion, respectively; and two terminal-housing grooves;

a first contact terminal, being disposed in one of the terminal-housing grooves of the terminal-fixing body; and a second contact terminal, being disposed in the other terminal-housing groove of the terminal-fixing body, wherein the terminal-fixing body may be driven to rotate by forcing to the turn handle and rotating the turntable, therefore the first contact terminal and the second contact terminal would contact with the terminals inside the switch device, and then the motor switched and controlled to make the forward rotation or the backward rotation.

2. The forward/backward rotation switching mechanism of claim 1, wherein the terminal-fixing body further comprising:

a ball housing, accommodating a fixing ball and a return spring used for fixing the terminal-fixing body; and a plurality of spring-accommodating grooves, being formed on the bottom of the terminal-fixing body.

3. The forward/backward rotation switching mechanism of claim 2, further comprising a plurality of terminal springs, being respectively accommodated in the spring-accommodating grooves and opposite to the first contact terminal and the second contact terminal in the terminal-housing grooves, wherein the elastic force provided by the terminal springs are able to make the first contact terminal and the second contact terminal contact with the terminals inside the switch device tightly.

4. The forward/backward rotation switching mechanism of claim 2, wherein the cover further comprising:

at least two ball recesses, being formed on the inner surface of the cover and corresponding to the turntable-corresponding recess, wherein the fixing ball would be pushed into the ball recess by the return spring when the terminal-fixing body stops rotating, and then the terminal-fixing body is fixed;

a plurality of locking structures, being formed on the edges of the cover and used for locking the switch device; and a circuitous embedding opening, being formed on the bottom of the turntable-corresponding recess and used for assembling with the top of the embedding member.

5. The forward/backward rotation switching mechanism of claim 1, wherein the turntable further comprising a plurality of dust-off trenches, being formed on the peripheral edges of the turntable for preventing from the dust accumulation between the turntable and the cover.

6. The forward/backward rotation switching mechanism of claim 2, wherein the return spring is a compression spring.

7. The forward/backward rotation switching mechanism of claim 2, wherein the terminal spring is a compression spring.

8. The forward/backward rotation switching mechanism of claim 1, wherein at least one terminal-locking portion is disposed in the terminal-housing groove.

9. The forward/backward rotation switching mechanism of claim 8, wherein the first contact terminal has at least one first locking portion for locking the terminal-locking portion in the terminal-housing groove.

10. The forward/backward rotation switching mechanism of claim 9, wherein the second contact terminal has at least one second locking portion for locking the terminal-locking portion in the terminal-housing groove.

* * * * *